United States Patent [19]

Suzuki et al.

[11] 4,086,374

[45] Apr. 25, 1978

[54] PRODUCTION OF MAGNETIC RECORDING MATERIAL

[75] Inventors: Masaaki Suzuki; Ryuji Shirahata; Masashi Aonuma; Tatsuji Kitamoto, all of Odawara, Japan

[73] Assignee: Fuji Photo Film Co., Ltd., Minami-ashigara, Japan

[21] Appl. No.: 680,418

[22] Filed: Apr. 26, 1976

[51] Int. Cl.[2] ..... H01F 10/00

[52] U.S. Cl. ..... 427/48; 427/132

[58] Field of Search ..... 427/127–132, 427/47–48, 428, 383, 435–438

[56] References Cited

U.S. PATENT DOCUMENTS

| | | | |
|---|---|---|---|
| 2,406,287 | 8/1936 | Grimshaw | 427/428 X |
| 2,865,783 | 12/1958 | Henderson et al. | 427/428 X |
| 3,261,711 | 7/1966 | Sallo | 427/132 X |
| 3,481,046 | 12/1969 | Kuroki et al. | 34/156 X |
| 3,814,672 | 6/1974 | Kitamoto et al. | 427/48 X |

*Primary Examiner*—Bernard D. Pianalto

*Attorney, Agent, or Firm*—Sughrue, Rothwell, Mion, Zinn and Macpeak

[57] ABSTRACT

An improved method of making a magnetic recording material comprises providing a ferromagnetic metal thin layer which has uniaxial anisotropy in any direction on a web by means of plating.

A plating solution is jetted onto the web through holes in a conveying pipe set in a plating bath. The web is then moved from the vicinity of the conveying pipe by the spouting force of the plating solution, and then conveyed along a helical path about the conveying pipe without contacting the surface of conveying pipe. Plating occurs while applying a magnetic field to the web.

14 Claims, 6 Drawing Figures

FIG 4
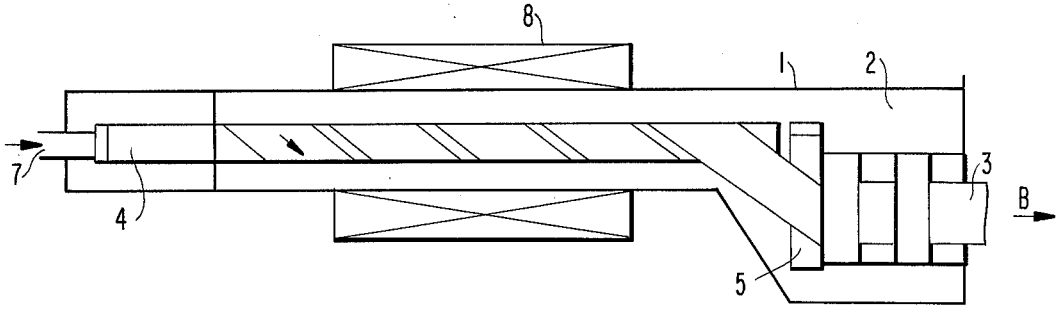
FIG 5
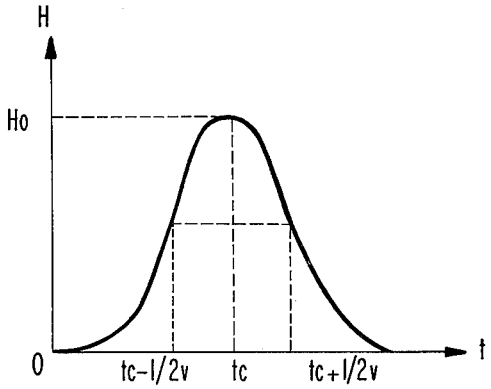
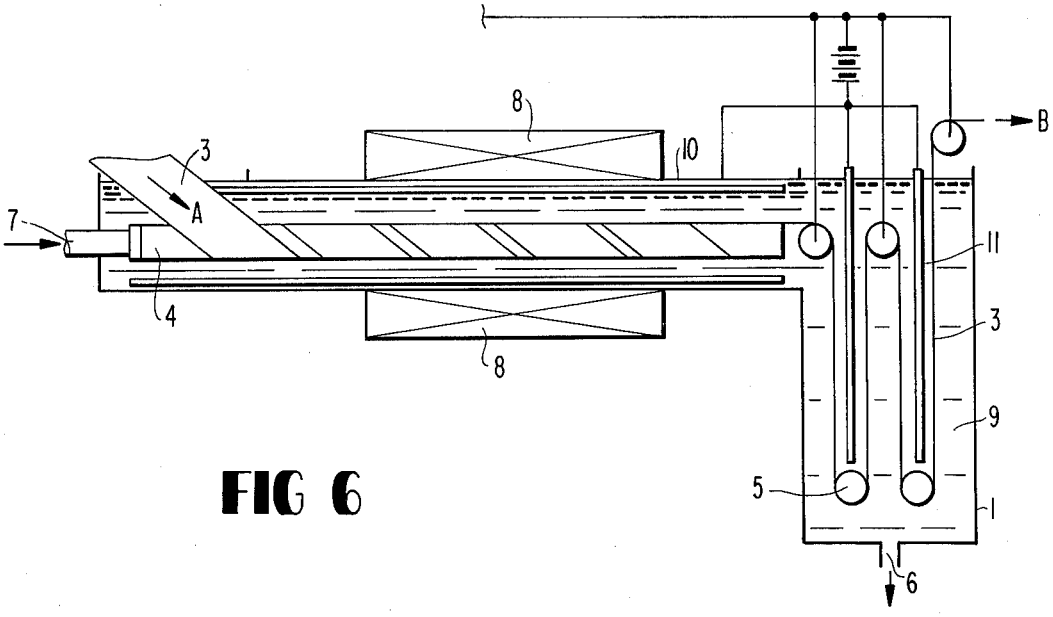
FIG 6

PRODUCTION OF MAGNETIC RECORDING MATERIAL

BACKGROUND OF THE INVENTION

1. Field of the Invention

This invention relates to a method of making a magnetic recording material, more particularly, to a method of making a magnetic recording material having a ferromagnetic metal thin layer, such as a magnetic tape, by a plating method.

2. Description of the Prior Art

It is known that ferromagnetic metal thin layers can be used for a magnetic recording materials. Firstly, because a thin magnetic recording layer provides a high saturated magnetic flux density, and, secondly, while a ferromagnetic metal thin layer can be used for magnetic recording in general, it is especially useful for high density magnetic recording due to its capability of exhibiting a very low to a very high coercive force.

As uses of ferromagnetic metal thin layers, it is known that a ferromagnetic metal thin layer having a low coercive force; i.e., a soft ferromagnetic metal thin layer, can be used as a core matrix memory element and an alternating current memory element, while a ferromagnetic metal thin layer having a high coercive force, i.e., a hard ferromagnetic metal thin layer, can be used as to a medium for magnetic recording as disclosed in, for example Soshin Chikazumi "Kyojiseitai no Butsuri" (Physics of Ferromagnetism) pages 327 to 330, published by Shyokabo Co., Ltd. Ferromagnetic metal thin layers are also useful for photomagnetic recording using a photomagnetic effect e.g., the Kerr magnetic effect, Faraday rotation, etc.

Further, it is known in the use of ferromagnetic metal thin layers that more effects appear when the ferromagnetic metal thin layer exhibits magnetic anisotropy. With respect to the orientation of such magnetic recording materials, this has been studied and is disclosed in U.S. Pat. Nos. 1,949,840; 2,418,479, Japanese Patent Publications 3427/1957; 21,158/1964, etc.

In order to obtain a ferromagnetic metal thin layer exhibiting magnetic anisotropy, many methods in which a web support is plated in a magnetic field have been proposed. The inventors of the present invention have also studied methods of making a ferromagnetic metal thin layer which is suitable for magnetic recording materials having a high coercive force, especially with respect to methods of applying uniaxial anisotropy to the ferromagnetic metal thin layer, and they made it clear in Japanese Patent Application (OPI) 15999/1974 that in order to obtain a ferromagnetic metal thin layer exhibiting uniaxial anisotropy, a magnetic field of a definite direction need not be applied during the total plating time, but need only be applied for a certain period after the beginning of plating.

The degree of orientation R is expressed as $R = (SQ// - SQ\perp)/(SQ// + SQ\perp)$. SQ is the ratio of the maximum magnetic flux density Bm to the residual magnetic flux density Br: Br/Bm, where the squareness ratio SQ// is measured along the axis of the easy magnetization direction and the squareness ratio SQ⊥ is measured at right angles to the axis of the easy magnetization direction. When a magnetic field as shown in FIG. 1 is applied during a plating process, R has the relationship as shown in FIG. 2.

In more detail, assuming that the time of finishing of magnetic field application $t_2$ is the time of finishing plating, the relationship of R to the time of beginning the magnetic field application $t_1$ is shown as a $t_1-R$ curve. The more $t_1$ increases, the more the period of magnetic field application and the R value decreases. On the other hand, assuming that $t_1$ is the time of beginning plating, the relationship of R to $t_2$ is shown as a $t_2-R$ curve. The more $t_2$ decreases, the more the period of magnetic field application and the R value decreases. It can be understood by comparing these two curves that the saturated R values of both curves are naturally equal to each other, and the time $t_0$ which indicates the half saturated R value of both curves are almost equal each other, too.

Expanding somewhat upon the above, assume that $t_1$ is the time between the time of beginning plating and the time of beginning magnetic field application and $t_2$ is the time between completing magnetic field application and completing plating. First, assume the time of completing plating is fixed at $t_2$; the case of changing $t_1$ will be discussed. In this case, the $t_1-R$ curve shows the changes in R. When $t_1$ is small, R is large since the period of orientation will be increased. On the other hand, when $t_1$ is large, R will be small since the period of orientation is decreased (when $t_1 = t_2$, $R = 0$). Second, assume the time of beginning plating is fixed at $t_1$; the case of changing $t_2$ will be discussed. In this case, the $t_2-R$ curve shows changes in R. If magnetic field orientation is halted a long period of time before the termination of plating, R will be small since the period of orientation is decreased. On the other hand, if $t_2$ approaches the time of completing plating, R will be large since the period of orientation is increased. When $t_1$ is small (magnetic orientation begins very shortly after plating) and $t_2$ is large (magnetic orientation ends very close to the end of plating), then the orientation time will be long, and, accordingly, R approaches the saturation value.

As one skilled in the art will appreciate, the squareness ratio of a magnetic recording material shows the difference between the orientation direction and a direction perpendicular to the direction of orientation. The greater the orientation value, the greater the difference between SQ // and SQ⊥, and the more R is increased. With reference to the $t_1-R$ curve, one can select an appropriate time on the $t_1-R$ curve which brings the R value to 90% of its saturated value, i.e., the time of beginning magnetic field application $t_a$ can be obtained. In a similar manner, with reference to the $t_2-R$ curve, the time of completing magnetic field application $t_b$ can be obtained.

Based on the above, one skilled in the art can easily select a R value under the conditions $t_1 = t_a$, $t_2 = t_b$.

In FIG. 2, assuming that $t_2$ is the time of finishing plating, $t_a$ corresponds to the value of $t_1$ indicating the time when the R value becomes 90% of the saturated R value, $t_1$ is the time of beginning plating, and $t_b$ corresponds to the value of $t_2$ indicating the time when the R value becomes the 90% of the saturated R value, a ferromagnetic metal thin layer having an almost saturated uniaxial anisotropy can be obtained with good efficiency by a plating in a magnetic field if $t_a$ and $t_b$ are selected as the time of beginning magnetic field application and the time of finishing magnetic field application, respectively, i.e., $t_1 = t_a$ and $t_2 = t_b$. Even if the period of magnetic field application is greatly reduced, the degree of orientation R which is 90% of the saturated value can be still obtained.

In this point, the degree of orientation R value of 90% of the saturated value is selected for $t_a$ and $t_b$. As one skilled in the art will appreciate, an extremely long orientation time is required to increase R to its saturation value, i.e., large scale magnetic field apparatus is required in a continuous process as is contemplated in the present invention. Accordingly, orientation is finished at a level lower than the saturation value. If this level was too low as compared with the saturation value, product quality problems sometimes occur. However, no problems are encountered on a commercial scale when R is about 90% or more, and, considering the orientation period, from a process viewpoint a value of about 90% of saturation is quite economical. This value is not, however, to be construed as limitative upon the present invention since the exact product quality required will vary from user to user, and in certain instances R values higher than 90% of the saturated value may be required by an user without any particular reference to process economics.

Since magnetic recording materials are used in many different applications as described before, orientation must be conducted in any direction. For instance, a magnetic tape for magnetic video recording must be oriented diagonally to the long direction.

Prior art processes where a magnetic field is applied while plating cannot provide a magnetic axis of easy magnetization in any desired direction. Further, it is not preferred that abrasion and/or a scratches occur on a web during conveying a web with a roller. Furthermore, if a process in which a web is conveyed without any contact was used in order to remove the defects produced by conveying with a roller, it was impossible to uniformly provide an orientation effect on the surface of the web since the conveying without contact was unstable due to flapping and the like.

SUMMARY OF THE INVENTION

One object of the present invention is to remove the defects of the prior art and to provide a process for the production of a magnetic recording material having a ferromagnetic metal thin layer which has superior magnetic properties in order to satisfy the demands for magnetic recording materials useful in different arts.

Another object of the present invention is to provide a process for the production of a magnetic recording material having a ferromagnetic metal thin layer to which can be applied an uniform uniaxial anisotropy in any arbitrary desired direction while in web form without forming any defects therein which lower quality, such as a scratch and the like.

These objects of the present invention are attained by plating while applying a magnetic field to a web which is kept away from the surface of a conveying pipe by the spouting force of plating solution spouted out through holes in the surface of the conveying pipe which is set in a plating bath, and conveying the web in a helical path along the conveying pipe without contacting the conveying pipe.

BRIEF DESCRIPTION OF THE DRAWINGS

FIG. 4 is a summary plane figure of FIG. 3.

FIG. 5 shows the orientating effect in the case of continuously plating while applying a magnetic field according to the present invention.

FIG. 6 is a general view of ferromagnetic metal thin layer production apparatus showing another embodiment of the present invention.

DETAILED DESCRIPTION OF THE INVENTION

Figure 3:
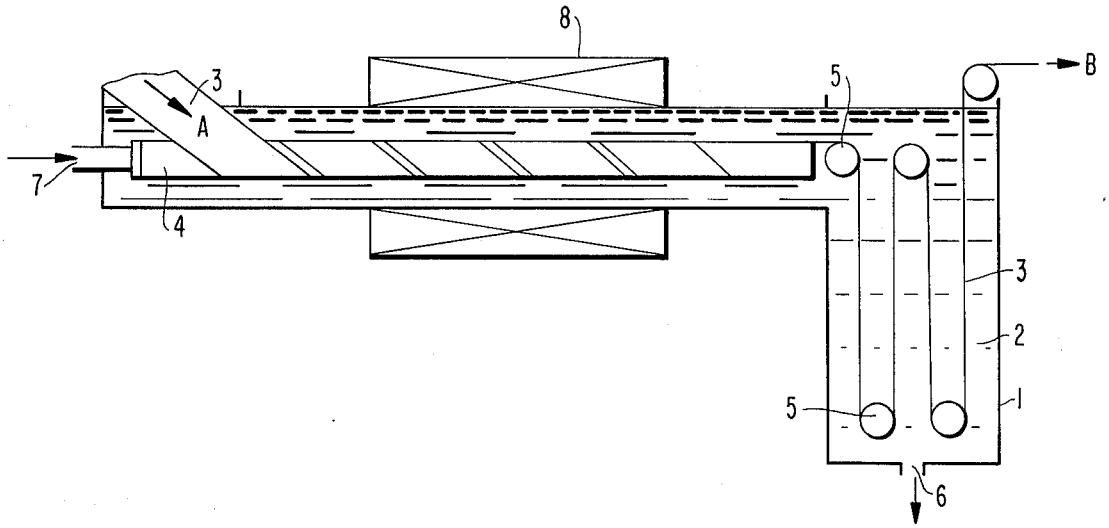
FIG. 3 is a general view of a ferromagnetic metal thin layer production apparatus showing an embodiment of the present invention.

FIGS. 3 and 4 are general views of a ferromagnetic metal thin layer production apparatus showing one embodiment of the present invention, wherein 1 is a plating solution tank filled with a conventional electroless magnetic plating bath 2 containing cobalt ions and hypophosphite ions, and 3 is a web. Web 3 can be, for example, a polyethylene terephthalate film, and is supplied into the plating solution tank in the direction indicated by the arrow A, and web 3 is taken out from the plating solution tank 1 in the direction indicated by arrow B. Web 3 is generally subjected to a conventional pre-treating process; for example, the web 3 is immersed in an aqueous sodium hydroxide solution (5 mol/l heated at 80° C) for 2 to 4 minutes in order to degrease, swell and roughen the web and then washed with water, immersed in or sprayed with an activating treating solution and lastly washed with water before supplying it into the plating solution tank 1. (none of the above conventional processings are shown in the figures).

Any well known processes can be used for the above described pre-treatment; for example, the processes disclosed in U.S. Pat. Nos. 2,702,253; 3,011,920; 3,142,582; 3,150,939; 3,245,826 and 3,532,518 can be used.

As one skilled in the art will appreciate, the mandatory step of electroless plating is, of course, to pass the material through the plating solution, or to contact the material with the plating solution, and, then, typically, to wash the plated material with water and dry the same. While degreasing, sensitization and activation are often practiced, they are not mandatory.

Typical electroless plating baths as may be utilized in accordance with the present invention are disclosed in the following U.S. Pat. Nos. 3,116,159; 3,219,471; 3,353,986; 3,370,979; 3,379,539; 3,416,932; 3,523,823; 3,549,417; 3,138,479; 3,238,061; 3,360,397; 3,372,037; 3,385,725; 3,446,657; 3,483,029; 3,702,263, etc.

Typical reducing agents used for electroless plating as can be utilized in the present invention are disclosed in U.S. Pat. Nos. 2,532,283; 2,583,284; and 2,658,842.

Typical electroplating baths as may be utilized in accordance with the present invention are disclosed in, for instance, U.S. Pat. Nos. 3,227,635; 3,578,571; 3,672,968; 3,489,661; 3,637,471; and 3,634,209, in British Pat. No. 1,322,365 and the like.

From the basis of the present invention, one skilled in the art will appreciate that the present invention is not limited to the above electroless plating bath, reducing agents or electrolytic plating baths.

The web 3 supplied into the plating solution tank 1 is conveyed in a helical path along the surface of a cylindrical conveying pipe 4 in the plating bath 2, and then the web 3 is taken out of the plating solution tank 1 via conveying roller 5. Conveying pipe 4 comprises a sintered metal pipe having many small holes of an average diameter of about 10 microns.

The plating bath 2 is generally continuously removed from the tank 1 via a circulation path which includes a filter for continuous operation. For example, a system for controlling the concentration, pH and temperature of the plating bath 2 can be provided in the circulation filter system in order to insure uniform plating conditions by controlling changes of the above factors with time. By such a removal and the circulation of plating solution, effects such as uniform continuous plating and an improvement in the surface properties of the magnetic thin film can be obtained since the re-introduction of the thus treated plating bath provides a fine movement and a convection current at the contact between the support being plated and the plating bath. As one skilled in the art will appreciate, the most important effect of the circulation-filter system is to remove foreign substances and/or dust from which might be introduced into the plating bath so as to maintain the composition thereof, with make-up, substantially identical to that of the original starting composition (constant process conditions).

The circulation and treatment of the plating bath 2 can be effected as follows; the plating solution is removed via outlet 6 and then the plating solution composition, etc., adjusted as required, and filtered, is introduced into the conveying pipe 4 via inlet 7 and spouted out onto the web 3 via the small holes (not shown in the figures) on the surface of the conveying pipe 4. The web 3 is thus slightly floated away from the surface of conveying pipe 4 by the spouting plating solution from the small holes of the conveying pipe 4 and is conveyed in a stable fashion without contacting the conveying pipe 4.

This conveying procedure is a modification of the technique disclosed in Japanese Patent Publication 20438/68, and an extremely stable conveying can be obtained using this conveying technique, that is, abrasion and scratching of the surface of web 3 due to contact between the web 3 and the conveying pipe 4 are prevented during conveying, and, further, flapping does not occur to any substantial extent. Accordingly, this "non-contact" conveying system is extremely useful in the present invention to obtain an uniform magnetic orientation effect. This Japanese patent publication (which corresponds to U.S. Pat. No. 3,481,046), of course, merely teaches web drying; it does not in any manner suggest the liquid plating/orientation of the present invention.

It should be clearly understood by one skilled in the art that the use of a circulation-filter system and a circulation path as above described is not mandatory in the present invention. No theoretical mechanism of the plating of the present invention requires the same. However, for economic reasons, such will generally be practiced since it permits long process runs with the plating bath. As will be apparent, usually the circulation rate is substantially equal to the ejection rate $x$ the cross-sectional area of the conveying pipe.

A magnetic field from a solenoid 8 is applied to web 3 while the web 3 is conveyed along the surface of the conveying pipe 4. The time distribution of the magnetic field applied to any point of web 3 from the solenoid 8 is as shown as FIG. 5.

The magnetic field applied to a point on the web 3 is $Ho = H(t_c)$ when the point is located at the center of the solenoid 8 and is $H = (t_c \pm 1/2\nu)$ when the point is located on both sides of the solenoid 8. Hence the direction of magnetic field is parallel with the axis of conveying pipe 4.

The web 3 starts to be plated as it enters the plating bath 2 (this point corresponds to "time-distance $t=0$) and the magnetic field is applied in the direction parallel to the axis of the conveying pipe 4 as the web 3 passes between the solenoid 8 as shown in FIG. 3 while the web 3 is moved along the surface of conveying pipe 4. Further, web 3 continues to be plated to complete the ferromagnetic metal thin film thickness required by passing the conveying roller 5 and is taken out from the plating tank 1. At this point, the web 3 has been subjected to an uniform magnetic field application since the web 3 is helically conveyed with excellent stability without contacting conveying pipe 4.

Figure 1:
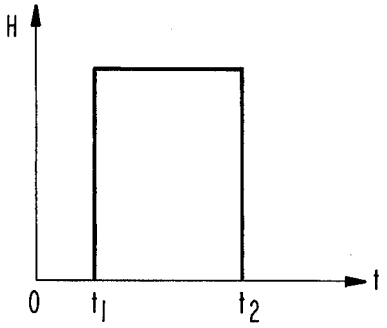
FIGS. 1 and 2 are theoretical figures to explain the process of applying a magnetic field with regard to the present invention.
Figure 2:
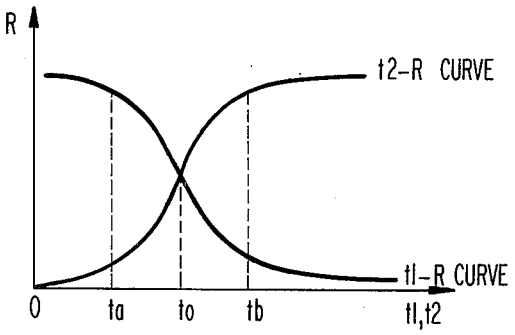

The manner of magnetic field application in the plating bath 2 disclosed in Japanese Patent Application (OPI) 15999/74 is used in the present invention. Namely, as is clear from the distribution of the magnetic field as shown in FIG. 5, in the case that a magnetic field is formed by solenoid 8 which is designed to make $1/\nu$ equal $(t_b - t_a)$ and the web is plated when the $t_c$ of FIG. 5 almost equals the $t_0$ of FIG. 2, R indicates the maximum saturation value, and, this time, an R value which is almost saturated can be obtained when $H_0$ is large enough. This fact was also experimentally confirmed. In more detail, from FIG. 2 it can be seen that when $t = t_0$, the inclination of the $t_1 - R$ curve and the $t_2 - R$ curve are largest, i.e., the orientation effect is most effective at $t = t_0$. Accordingly, to obtain the most effective orientation, the magnetic field should be applied in such a manner that the largest power is applied at $t = t_0$, considering the orientation effect R is maximized when the magnetic field is applied at $t_c = t_0$.

Since the web 3 is in helical form along the surface of the conveying pipe 4, it can be understood that each arrival time at the time $t_c$ of each point which is on a straight line and perpendicular to a center line of the web 3 will differ from each other. However, the magnetic field is applied, as discussed above, in an amount sufficient to effect saturation, based on the time, that is, the magnetic field required to orientate each point of the web is applied. Accordingly, it was confirmed that the orientation effect was sufficient, although the arrival time of each point was different.

Discussing the above in somewhat greater detail, as will be apparent from the above discussion the magnetic field orientation must begin at a certain time and must finish at a certain time during the plating. On the other hand, as one skilled in the art will appreciate, since the web is conveyed in helical form around the conveying pipe, different points along a line transverse the center line of the web are not immersed at exactly same time into the plating bath, i.e., if it is assumed that the web enters the plating bath with the center line of the web making some angle with respect to the plating bath (vertical orientation of the flat plane of the web), the lowermost portion of the web will enter the plating bath prior to the uppermost portion of the web. Keeping in mind that orientation must begin at a certain time and finish at a certain time in the plating period, this demand cannot be satisfied unless each point on a line transverse the center line of the web undergoes an identical magnetic field orientation. Assuming that the line of solenoid magnetic field application is vertical, it will be seen that the point which last enters the plating bath in the above illustration arrives first at the vertical solenoid magnetic field application line, i.e., despite the fact that this point undergoes the minimum plating period it receives the first magnetic field orientation. Each point on the line transverse the center line of the web thus has different period of arrival at the magnetic field orientation center line. This problem is effectively overcome, however, by the process of the present invention.

Assuming that the outside diameter of the conveying pipe 4 is "D", the width of the web 3 is "$a$" and an angle between the long direction of the web 3 and the direction of the axis of easy magnetization; i.e., an angle between the long direction and a direction of the magnetic field is "$\theta$", the web 3 can be conveyed without overlapping, i.e., without alternate coils of the helices, when the relationship of "$a$", "D" and "$\theta$" is $a/\cos\theta\lambda < \pi D$. Accordingly, a ferromagnetic metal thin layer having a preferred axis of easy magnetization can be obtained by properly selecting the outside diameter D of the conveying pipe 4 for a width $a$ of the web 3.

The web 3 thus plated while having a magnetic field applied therto is then ordinarily subjected to a coarse washing with a spray of recycled water, running water and boiled water followed by drying in a hot air stream duct or in an infrared furnance. (typically, the conditions utilized in the earlier cited patents teaching electroless or electroplating can be used).

The plating bath used for the present invention can be selected from any plating bath which can deposit a ferromagnetic metal thin layer from a liquid phase, e.g., an electroplating bath, an electroless deposition bath and the like.

The aforesaid embodiment illustrates the case of an electroless plating. On the other hand, it can be easily understood that the system as shown in FIG. 6 can be used in the case of an electroplating. In FIG. 6, 9 is an electromagnetic plating bath and 10 and 11 are anode plates. Other numerals have the same meaning as in FIG. 3.

The web used in the present invention can be selected from any materials which are flexible and capable of being plated; e.g., thin materials of plastics, rubbers, metals, alloys and ceramics, or laminates thereof, for example, a plastic/metal laminate e.g., plastics such as polyethylene terephthalate, polypropylene, triacetyl cellulose, diacetyl cellulose, polyvinyl chloride, polycarbonate, etc., alloys such as stainless steel, etc., metals such as foils or leafs of copper, aluminum, etc.

The conveying pipe used in the present invention can be selected from any materials which generally have the external form of a cylindrical tube and are corrosion resistant and durable in the plating bath, e.g., metals, alloys, ceramics, rubbers and plastics, for example, stainless steel and brass are often profitably used. Especially, a sintered pipe of metal is conveniently used convey the web with uniform floating. The diameter of the holes on the conveying pipe is about 1 to about 1000 microns, preferably about 5 to 100 microns. The hole density which is expressed by the ratio of the area occupied by the holes to the surface area of conveying pipe is about 1 to about 50%, preferably 5 to 20%. Further, the distribution of holes is substantially uniform.

The velocity of the plating solution spouted from the holes of conveying pipe is sufficient to slightly float the web away from the surface of the conveying pipe by keeping a balance with the tensile force of the web.

The magnetic field generator useful in the present invention is not limited only to a solenoid as described but any material which is well known such as an electromagnet, a magnet and the like can be used. For instance, the magnet can be prepared in the same shape as the solenoid earlier described with a hole therethrough, and such is used in the same manner as the solenoid. As another example, a magnetic field in the direction of the circumference of the conveying pipe can be generated by setting materials of good electrical conductive, such as a super-conductive material, in the conveying pipe and charging a high electrical current therethrough.

According to the present invention the novel effects disclosed below are obtained.

(1) It is possible to obtain a magnetic recording material having an axis of easy magnetization in any directions by properly selecting the angle of the web with respect to the conveying pipe. The exact angle selected is, of course, dependent upon the type of product desired; generally, it is on the order of about 10° to about 75°, with typically 50° or less being used for video tape and 20° less being used for audio tape, with reference to the center-line of the conveying pipe. These ranges are merely recited as illustrative, and are not to be construed as limitative.

(11) It is possible to obtain a magnetic recording material having an uniform magnetic field orientation effect since the magnetic field for orientation is applied to the web while conveying the web in a plating bath in a "non-contacting" helical manner, as disclosed in Japanese Patent Publication 20438/1968.

(111) It is possible to produce a magnetic recording material having superior magnetic properties without the occurence of surface faults which lower quality such as scratches and the like.

It is believed that the heretofore offered disclosure makes clear the broad nature of the present invention. As should be clear to one skilled in the art considering the foregoing disclosure, so long as the essential spirit of the invention as heretofore described is followed, the process parameters of the present invention can be widely and substantially varied. However, as with any processing invention, certain preferred and highly preferred conditions do exist for general operation on a commercial scale, and these are discussed in more detail below. The following disclosure should not be taken as limitative on the present invention, merely illustrative of currently preferred modes of practicing the invention.

The plating of the present invention is typically performed at a temperature of 0° to 100° C; temperatures lower than 0° C are obviously not used due to the possibility of freezing, and temperatures above 100° C are not used at atmospheric pressure due to the possibility of system boiling. Higher temperatures could be used, of course, if one would wish to go to higher pressures, but little is to be gained by such a procedure. A most preferred range of operation is from 20° to 90° C.

The plating of the present invention is conveniently performed in a time as little as 2 to 3 seconds, or may be performed over a time of several hours. As one skilled in the art will appreciate, the plating rate and the thickness of the resulting plated layer can be varied depending upon the type of product desired. Accordingly, it is impossible to give an unequivocal range for the plating time.

As generally alluded to above, plating is most conveniently performed at atmospheric pressure, though nothing would, in theory, prevent one from plating at sub- or super-atmospheric pressure. The extra apparatus required in such cases, however, renders such commercially undesirable.

The thickness of the plated layer is not unduly restricted, but considering currently desired commercial products, usually plated layers having a thickness of from about 0.05 to about 1 μ are obtained, even more preferably from 0.05 to 0.5 μ.

The support can, in a similar fashion, have various thickness, depending upon user requirements. Again, for most important commercial products as are currently desired in the art, supports typically have a thickness on the order of about 1 μ to about 100 μ.

The magnetic field intensity applied during the plating of the present invention can be widely varied, depending on the requirements of the user of the product. Typically, for a soft magnetic thin layer a magnetic field intensity on the order of about 1 to about 100 Oe is utilized, while, on the other hand, for a hard magnetic thin layer an intensity of about 10 Oe or greater is used. Applying conventional techniques in the art (utilizing conventional magnetic orientation fields), usually the maximum magnetic field intensity used is about 3,000 Oe.

As one skilled in the art will appreciate from the heretofore offered discussion, a certain liquid flow rate or impact force against the "floating" support is necessary to maintain the same away from the conveying pipe. The general rule in this regard is that the exact value determined for any particular process run is best empirically determined. Such can, generally, be determined in an easy fashion; for example, without the application of the magnetic field a process run is conducted at a certain liquid flow rate; if a proper "floating" effect is achieved, thereafter actual plating is conducted. However, if, for example, the support contacts the conveying pipe, the liquid flow rate is increased, while, on the other hand, if turbulence or the like is noted, i.e., the liquid flow rate is so high that the support begins to waver in the plating bath, the liquid flow rate is decreased. Generally, flow rates in the order of 0.05 to about 1000 cc/cm$^2$. min., even more preferably 1 to 100 cc/cm$^2$. min., (per cm$^2$ of the cross-sectional area of the conveying pipe) are utilized in combination with supports as earlier defined.

The present invention will be illustrated in greater detail by reference to the following examples. Unless otherwise indicated, all parts, percents, ratios and the like are by weight. In the example, the apparatus shown in FIG. 3 was utilized.

EXAMPLE

After a polyethylene terephthalate film having a width of 520 mm and a thickness of 25 microns was immersed for 3 min. in a sodium hydroxide aqueous solution (5 mole/liter) heated to 80° C to conduct a degreasing, swelling and surface roughening, the polyethylene terephthalate film was washed in flowing water for 2 min. at room temperature and then immersed in the solution disclosed in Table 1 for 2 min. at room temperature and then washed in flowing water for 2 min. at room temperature. The film was again immersed in 5% dilute sulfuric acid for 2 min. at room temperature and washed in flowing water for 2 min. at room temperature. The polyethylene terephthalate film was thus activated in the manner as above described.

The polyethylene terephthalate film thus prepared was passed in an electroless plating bath having the composition described in Table 2 which was heated to 80° C and had a pH of 7.3 ± 0.1 by adding a sodium hydroxide aqueous solution. The immersion time in the plating bath was 4 min.

A sintered metal pipe having an outer radius of 100 mm (pipe wall thickness was minimal, and can be ignored; the average diameter of holes thereon was 10 microns, and the ratio of the area occupied by the holes to the surface area of the pipe was 10%) was employed as the conveying pipe. In this example, the plating fluid was ejected through the holes at a total flow rate of 50 cc/cm$^2$. min. the surface area of the pipe. The film was taken on the conveying pipe to make the winding angle of 30° and conveyed at a linear velocity of 10 m/min. In this example, $t_0$ was 30 sec., $t_a$ was 15 sec., $t_b$ was 45 sec. ($t_a$ and $T_b$ were selected from the values of $t$ which make R=90% of the saturation value) and the value of the magnetic field required to obtain the saturated value of R was 1300 Oe; a solenoid having a cylindrical, inner hollow area 300 mm in diameter and a length of 4.33 m was employed.

In this example, a circulation — filter system was not utilized. However, if one had been utilized, a filter would be provided to remove particulate materials found in the plating bath and, for long — term process runs, make-up components would be added at a point in the circulation — filter system so as to maintain the original composition of the plating bath. If such a circulation — filter system was utilized, the circulation rate in this example would be 50 cc/cm$^2$. min. × the cross-sectional area of the circulation pipe.

TABLE 1

| | |
|---|---|
| $PdCl_2$ | 1 g |
| $SnCl_2$ | 10 g |
| HCl (35%) | 10 ml |

These components were dissolved in ion exchanged water to make 1 liter.

TABLE 2

| | |
|---|---|
| $CoCl_2 \cdot 6H_2O$ | 0.04 mole |
| Citric acid | 0.09 mole |
| $NH_4Cl$ | 0.20 mole |
| Boric acid | 0.50 mole |
| $NaH_2PO_2 \cdot H_2O$ | 0.06 mole |

These components were dissolved in ion exchanged water to make 1 liter.

The polyethylene terephthalate film plated and orientated by magnetic field in this manner was subjected to a coarse washing, running water, boiling water washing and dried in an infrared furnace.

The magnetic properties of the magnetic material obtained in the Example are shown in Table 3. In this example, the plated layer was 0.1 μ thick. Further, it was confirmed that the orientation effect due to the magnetic field were uniform.

TABLE 3

| | | |
|---|---|---|
| $\phi m$ | 0.10 | Mx/cm |
| Hc// | 830 | Oe |
| Hc⊥ | 820 | Oe |
| SQ// | 0.84 | |
| SQ⊥ | 0.64 | |
| R | 0.135 | |

$\phi m$ is the magnetic flux per unit length; Hc// is the coercive force in the same direction as the axis easy magnetization and Hc is the coercive force in the direction vertical to the axis of easy magnetization.

While the invention has been described in detail and with reference to specific embodiments thereof, it will be apparent to one skilled in the art that various changes and modification can be made therein without departing from the spirit and scope thereof.

We claim:

1. In a plating process for producing a magnetic recording material which comprises a ferromagnetic thin metal layer on a web and having uniaxial anisotropy applied in any desired direction by passing said web through a liquid plating solution to deposit said layer on said web while applying a magnetic field to said web during at least a portion of said plating process, the improvement comprising the steps of:

conveying said web through said magnetic field in a helical path along the length of a conveying pipe immersed in said liquid plating solution, said pipe containing a plurality of orifices, introducing said liquid plating solution into one end of said pipe, and ejecting said liquid plating solution from inside said pipe through said orifices and against the adjacent surface of said web in said magnetic field with sufficient force to float said web out of contact with said pipe.

2. The process of claim 1, wherein said magnetic field has a strength of from about 1 to about 100 oe to form a soft magnetic thin layer and wherein said magnetic field has a strength of about 10 Oe to about 3,000 Oe to form a hard magnetic layer.

3. The process of claim 1, wherein said plating process is an electroless plating process.

4. The process of claim 1, wherein said plating process is an electroplating process.

5. The process of claim 1, wherein said ferromagnetic thin metal layer has a thickness of from about 0.05 to about 1 $\mu$.

6. The process of claim 5, wherein said web has a thickness of from about 1 to about 100 $\mu$ and is flexible.

7. The process of claim 1, wherein said plating solution is ejected at a rate of from about 0.05 to about 1000 $cc/cm^2/min.$, where $cm^2$ is the cross-sectional area of said conveying pipe.

8. The process of claim 7, wherein said plating solution is ejected at a rate of from 1 to 100 $cc/cm^2/min.$ 9. The process as claimed in claim 1, wherein said web forms an angle with said conveying pipe of from about 10° to about 75° relative to the center line of said conveying pipe.

10. The improvement as defined in claim 1, wherein said ferromagnetic layer is deposited on said adjacent surface of the web.

11. The improvement as defined in claim 1 further comprising applying the magnetic field in a direction parallel to the length of said pipe.

12. The improvement as defined in claim 1 further comprising applying the magnetic field from a magnetic field source which is external to both said solution and said pipe.

13. The improvement as defined in claim 1 wherein said pipe is made of non-magnetic material.

14. The improvement as defined in claim 1 further comprising applying a constant magnetic field to said web.

* * * * *

UNITED STATES PATENT OFFICE

CERTIFICATE OF CORRECTION

Patent No. 4,086,374 Dated April 25, 1978

Inventor(s) Masaaki SUZUKI, Ryuji SHIRAHATA, Masashi AONUMA, Tatsuji KITAMOTO

It is certified that error appears in the above-identified patent and that said Letters Patent are hereby corrected as shown below:

Under FOREIGN APPLICATION PRIORITY DATA:

Please insert -- April 25, 1975 Japan.....50498/75--

Signed and Sealed this

*Fifth* Day of *September 1978*

[SEAL]

*Attest:*

RUTH C. MASON
*Attesting Officer*

DONALD W. BANNER
*Commissioner of Patents and Trademarks*